US006513237B1

(12) United States Patent
Ohtsuki

(10) Patent No.: US 6,513,237 B1
(45) **Date of Patent: *Feb. 4, 2003**

(54) METHOD FOR PRODUCING PRESSIN CONTACT

(75) Inventor: Tomonari Ohtsuki, Tokyo (JP)

(73) Assignee: DDK Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 68 days.

(21) Appl. No.: 09/663,495

(22) Filed: Sep. 18, 2000

(30) Foreign Application Priority Data

Jan. 25, 2000 (JP) ..... 2000-015570

(51) Int. Cl.[7] ..... H01R 43/04

(52) U.S. Cl. ..... 29/882; 29/874; 29/DIG. 18; 72/326; 72/356; 439/84; 439/876

(58) Field of Search ..... 29/845, 874, 882, 29/747, 881, 832, 837, 838, 842, 876, 839, 741, 754, 795, 797, DIG. 18, DIG. 37; 72/356, 326, 325, 332; 439/82–84, 751, 876

(56) References Cited

U.S. PATENT DOCUMENTS 4,407,056 A * 10/1983 Watanabe et al. ..... 29/527.7
4,691,979 A * 9/1987 Manska ..... 439/83
4,776,807 A * 10/1988 Triner et al. ..... 439/82

* cited by examiner

*Primary Examiner*—Richard Chang
(74) *Attorney, Agent, or Firm*—Baker Botts LLP

(57) ABSTRACT

A method for producing a press in contact having a press-fitting portion having a U-shaped or V-shaped groove in cross-section to be press-fitted in a cylindrical through-hole of a printed circuit board. A block element having a rectangular cross-section corresponding to the press-fitting portion of the contact is formed at its center with a concaved portion by forging. Both the ends of the forged block element are removed by punching. Thereafter, the remaining U-shaped or V-shaped press-fitting portion in cross-section is further so worked by press working that its outer periphery is formed into arcs which are concentric to the through-hole when the press-fitting portion has been press-fitted and fixed therein.

2 Claims, 6 Drawing Sheets

Prior Art

METHOD FOR PRODUCING PRESSIN CONTACT

BACKGROUND OF THE INVENTION

This invention relates to a method for producing a press-in contact having a connection portion to be connected to an electric cable or a circuit of a board, a press-fitting portion to be press-fitted in a through-hole of a printed circuit board, and a contact portion to contact a contact of a mating connector. More particularly, the invention relates to a method for producing a press-in contact which is able to minimize any damage of the contact and a through-hole plated portion, to improve the mechanical property of the contact at its press-fitting portion and in the proximity thereof in order to prevent these portions from being bent or broken, and to stabilize the holding force for retaining the contact in the through-hole owing to the symmetrical shape of the press-fitting portion having no irregularity in shape and size without any rotation of the contact in the through-hole when being press-fitted thereinto.

In general, press-in contacts of this kind are made of a springy copper alloy such as phosphor bronze and beryllium copper. It is ideal to make a press-in contact whose press-fitting portion can apply stresses uniformly to the inner surface of a cylindrical through-hole of a printed circuit board when the press-fitting portion is being press-fitted into the through-hole. For this purpose, with the press-in contact having a press-fitting portion adapted to be forced to reduce its outer diameter enabling it to be inserted into the through-hole, the press-fitting portion has been formed by repeatedly drawing a plate material to obtain finally a U-shaped or V-shaped cross-section whose outer periphery has two arc portions and a straight portion therebetween and whose inner periphery has an inscribing circle whose center is eccentric to the two arc portions.

Moreover, the thickness of the two arc portions in cross-section progressively decreases on proceeding toward the open ends of the U-shaped or V-shaped groove so that the circumferential lengths of the two arc portions contacting the through-hole become longer as much as possible.

With such a known press-in contact, residual stresses are accumulated in the press-fitting portion when being formed so that the mechanical properties in the portion and its proximity deteriorate to decrease its durability, causing the portion to be readily bent or broken by bending stresses. With the known press-in contact, moreover, as the press-fitting portion is formed by repeatedly drawing a plate material so as to be progressively bent to obtain a U-shaped or V-shaped groove, there are in side walls of the U-shaped or V-shaped groove irregularities in shape and size including thickness and length due to slight difference in working for example, by the fact that different parts are worked at different times.

As a result, the outer ends of the side walls of the U-shaped or V-shaped groove frequently do not closely contact the inner surface of the through-hole and the press-in contact tends to rotate in the through-hole so that the contact between the press-fitting portion and the through-hole would become unstable and the holding force therebetween would be decreased.

SUMMARY OF THE INVENTION

It is an object of the invention to provide an improved press-in contact which eliminates all the disadvantages of the press-in contacts of the prior art described above and which is durable in use and able to provide stable holding force and stable contact between the press-in contact and a through-hole of a printed circuit board.

In order to accomplish this object, in a method for producing a press-in contact having a press-fitting portion to be press-fitted in a cylindrical through-hole of a printed circuit board, and a contact portion to contact a contact of a mating connector, said press-fitting portion having in cross-section an inner periphery forming a U-shaped or V-shaped groove and an outer periphery including two arc portions and a straight portion therebetween, said inner periphery having an inscribing circle whose center is eccentric to the center of the two arc portions of the outer periphery, and the thickness of said two arc portions in cross-section progressively decreasing on proceeding toward the open ends of walls of said U-shaped or V-shaped groove so that circumferential lengths of said two arc portions contacting the through-hole of the printed circuit board become longer as much as possible, according to the invention said method comprises steps of forming a concaved portion in a block element having a rectangular cross-section at its center by forging, removing both ends of said block element by punching, and then forming the outer periphery of the remaining U-shaped or V-shaped press-fitting portion in cross-section by press-working into arcs which become concentric to said through-hole when said press-fitting portion has been press-fitted and fixed therein.

The press-in contact having the press-fitting portion formed by forging, punching and press-working according to the invention has an advantage of less deterioration of mechanical properties or attributes owing to less working ratio, in comparison with those of the prior art. In other words, the press-fitting portions of the press-in contacts of the prior art have been formed by drawing and bending to generate a great quantity of residual strains in the portions which would act to elongate the portions in lengthwise directions. In contrast herewith, the press-fitting portion of the press-in contact according to the invention is formed by forging, punching and press-working to considerably reduce residual strains, and the residual strains, if any, will act to compress toward each other in lengthwise directions to improve the mechanical properties and attributes of that portion, with consequent less chance of its deformation and damage.

Moreover, the press-fitting portion of the press-in contact according to the invention is formed clearly in symmetry without any irregularity in shape and size, thereby preventing the ends of side walls of the U-shaped or V-shaped groove of the portion from separating from the inside of the through-hole of a printed circuit board, and the press-in contact from rotating in either direction in the through-hole, and hence preventing the contacting state with the board from becoming unstable and the holding force therebetween from decreasing.

The invention will be more fully understood by referring to the following detailed specification and claims taken in connection with the appended drawings.

DESCRIPTION OF THE PREFERRED EMBODIMENTS

Figure 2:
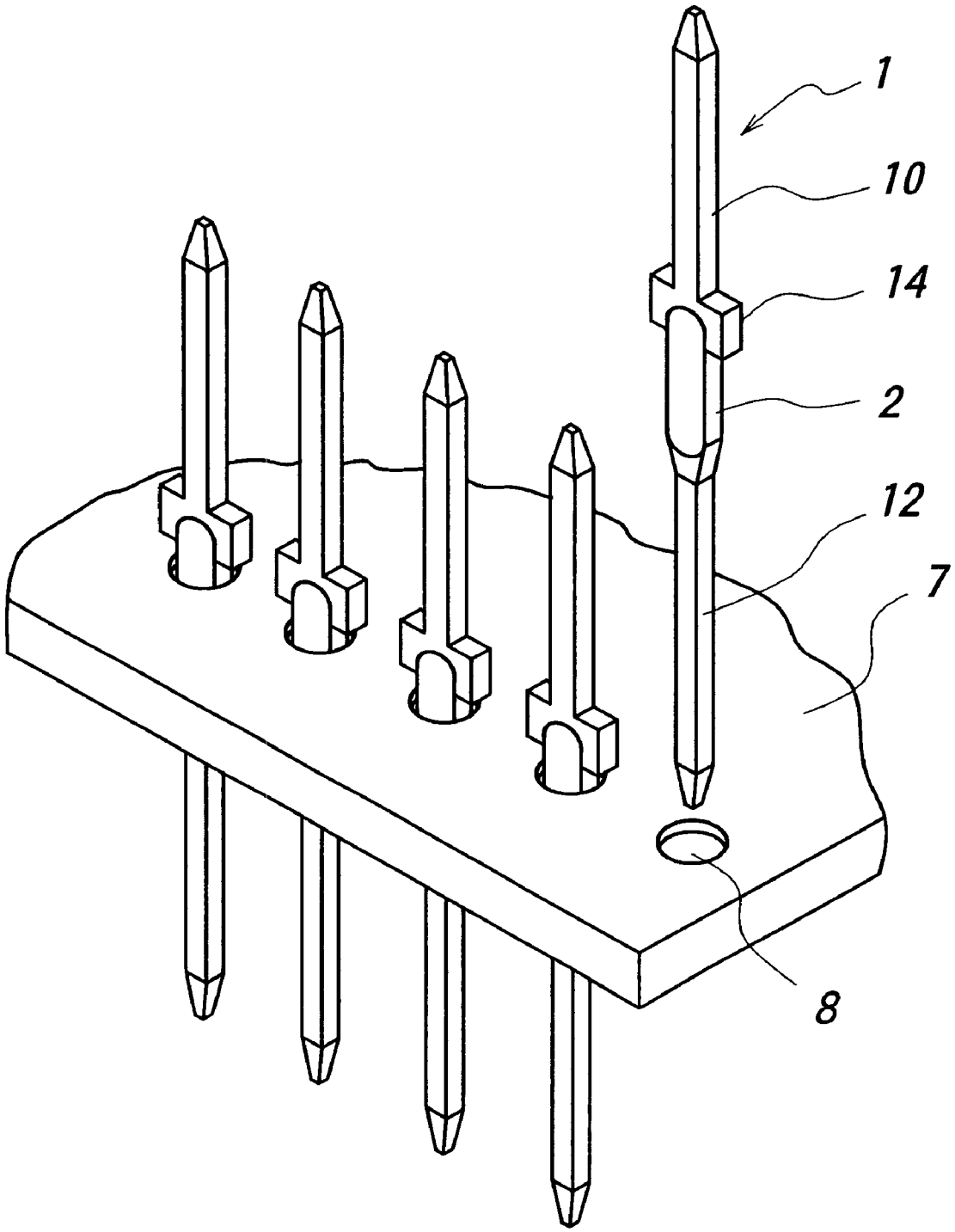
FIG. 2 is a perspective view of press-in contacts inserted in through-holes of a printed circuit board.
Figure 3:
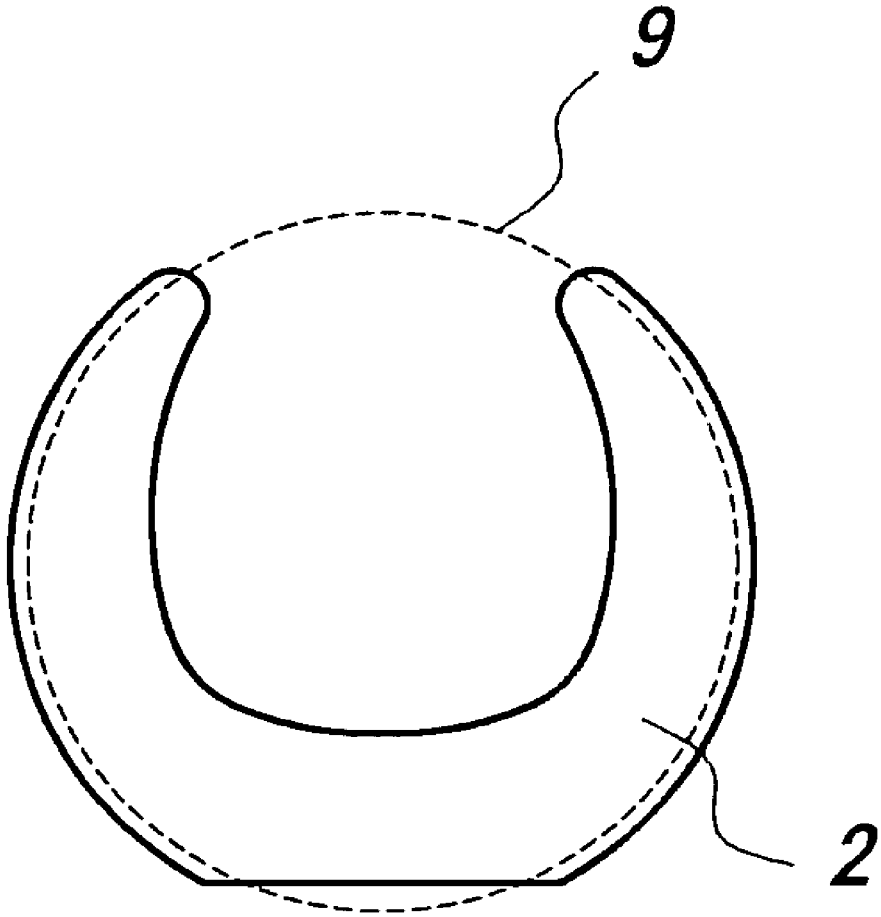
FIG. 3 is a cross-sectional view of the press-fitting portion of a press-in contact according to the invention inserted in a through-hole shown in an imaginary line.

One embodiment of the invention will be explained with reference to FIGS. 1 to 3 hereinafter. The press-in contact 1 according to the invention mainly consists of a connection portion 10, a press-fitting portion 2, and a contact portion 12 as shown in FIG. 2. In this embodiment, the press-in contact 1 is provided with a positioning portion 14 between the connection portion 10 and the press-fitting portion 2 for positioning the press-in contact 1 relative to a printed circuit board 7 onto which the press-in contact 1 is mounted.

Figure 1:
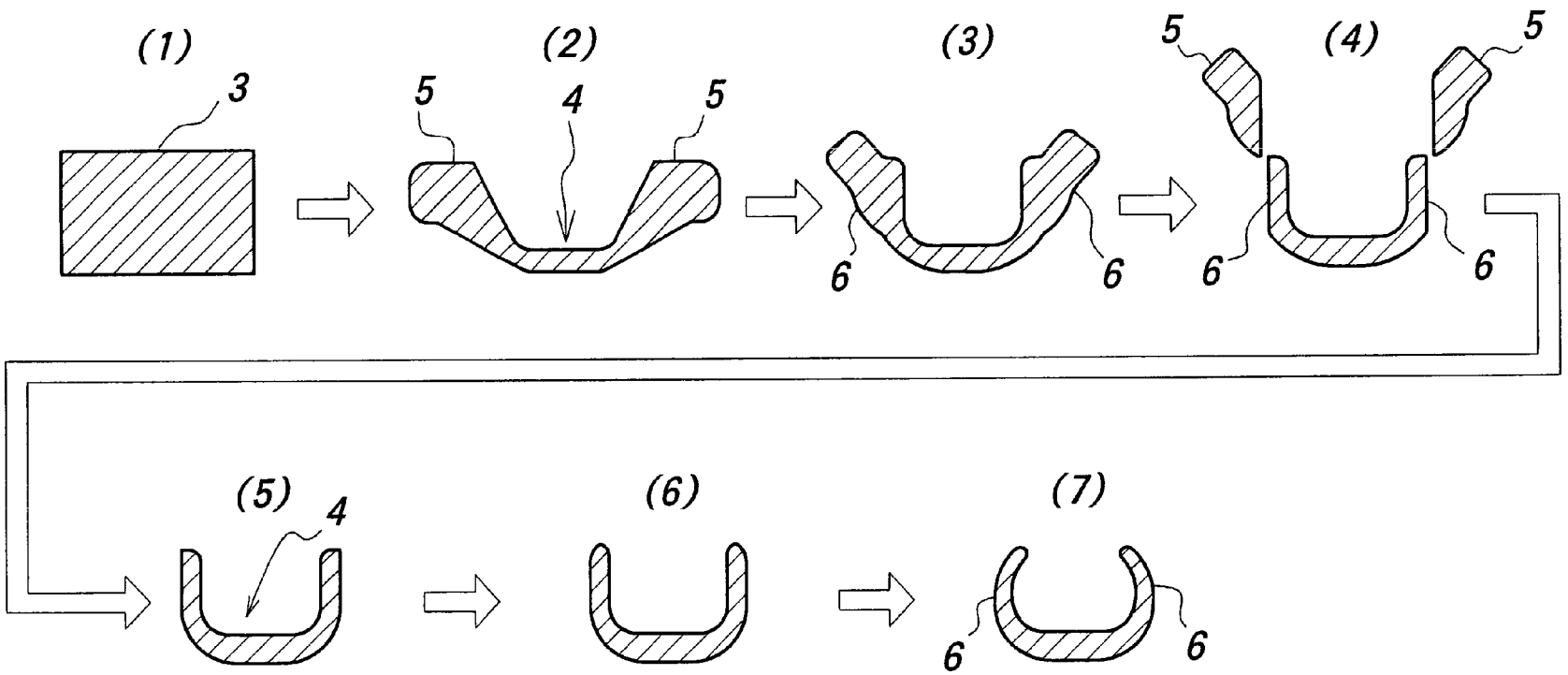
FIG. 1 schematically illustrates steps (1) to (7) of producing the press-fitting portion of a press-in contact according to the invention.

FIG. 1 illustrates steps of forming the press-fitting portion 2 of the press-in contact 1 according to the invention with cross-sections of the press-fitting portion 2 consecutively changed in the successive steps. In step (1), the press-in contact 1 is formed by blanking or punching a plate, whose press-fitting portion 2 is rectangular in cross-section as shown by a reference numeral 3. In this state, a number of contacts are connected to one another. In step (2), the rectangular press-fitting portion 2 in cross-section is concaved to form a U-shaped or V-shaped groove 4 by forging. In step (3), the side walls 6 of the groove 4 are forced closer to each other by bending. In step (4), extra portions 5 of the press-fitting portion 3 are removed by punching. The bottom of the groove 4 is rounded with its exterior in step (5), the upper edges of the groove are rounded in step (6) and the side walls 6 are curved slightly inwardly in last step (7) by press-working as shown in FIG. 1. Finally, the press-in contacts thus formed are cut away from the metal plate.

Figure 4:
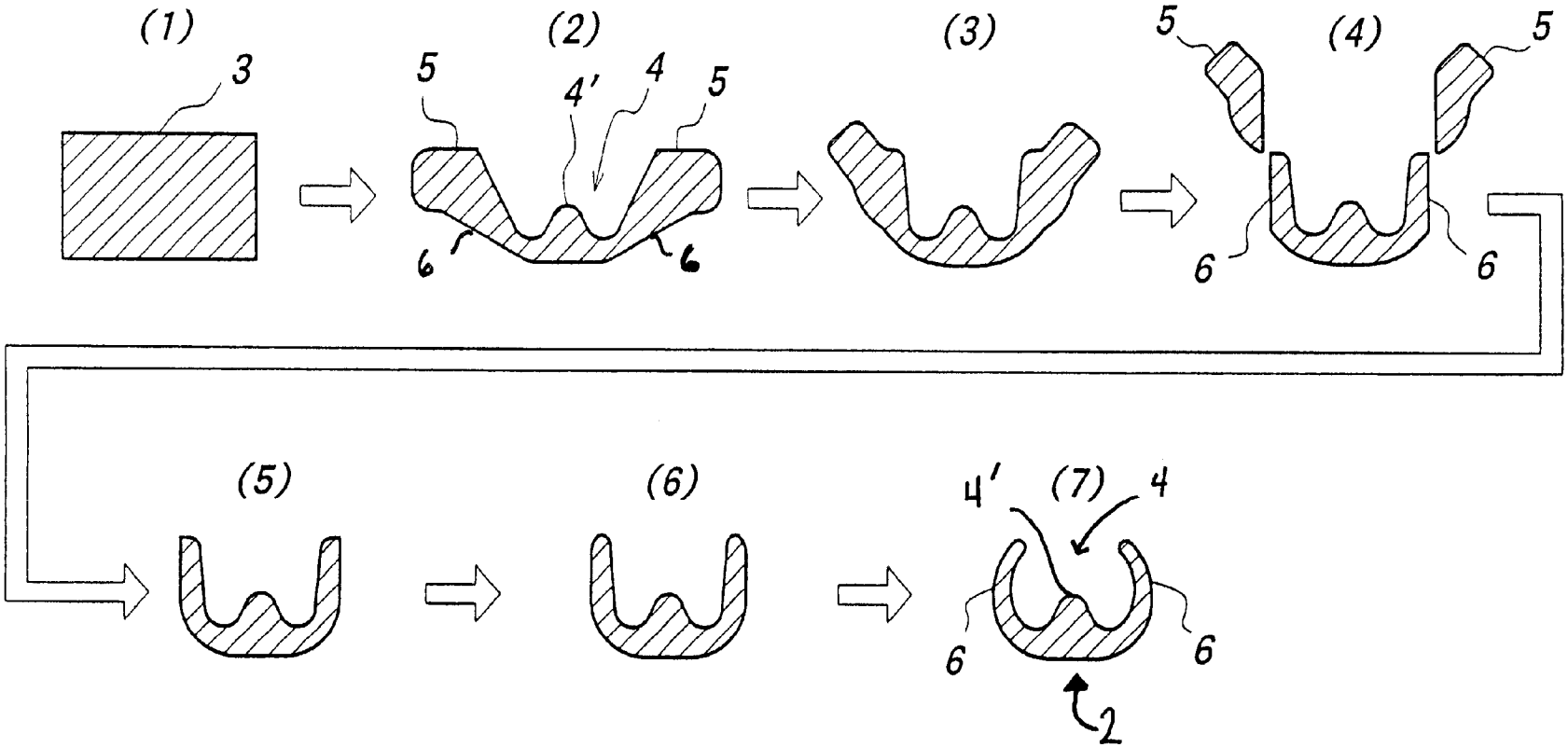
FIG. 4 schematically illustrates steps of producing the press-fitting portion of a press-in contact according to another embodiment of the invention.

Another embodiment of the invention shown in FIG. 4 is substantially similar to that shown in FIG. 1, with the exception that the press-fitting portion shown in FIG. 4 has a protrusion or ridge 4' provided at the center of the bottom of the U-shaped or V-shaped groove 4 over its full length so as to project outwardly toward the open end of the U-shaped groove 4. Such a protrusion or ridge 4' is formed in step (2) together with the U-shaped groove 4 by forging. Thereafter, extra portions 5 are removed by punching in step (4) and side walls 6 are curved inwardly by press-working in the similar manner to the embodiment shown in FIG. 1.

The press-in contact 1 is inserted into one of through-holes 8 formed in a printed circuit board 7 made of glass-fiber reinforced epoxy resin as shown in FIG. 2. At that time, it is needed to form the press-fitting portion to have a cross-section such that the press-fitting portion is brought into contact with the inner surface 9 of the through-hole 8 substantially uniformly.

Figure 5:
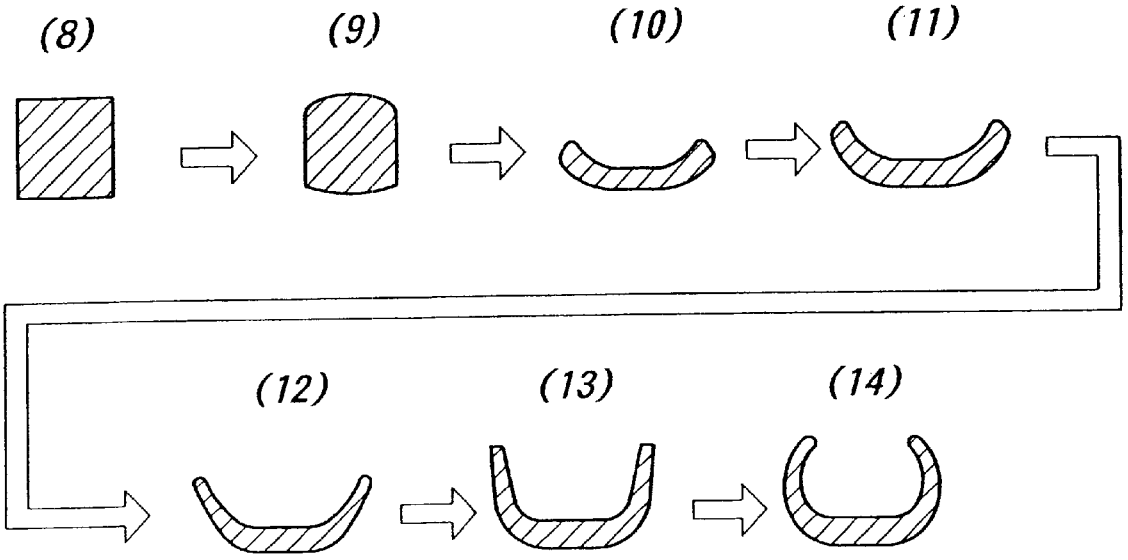
FIG. 5 schematically illustrates steps (8) to (14) of producing the press-fitting portion of a press-in contact of the prior art.

For this purpose, in the prior art as shown in FIG. 5, the press-fitting portion of a press-in contact is formed by blanking or punching in step (8), drawing the surfaces in step (9) preparatory to the following drawing steps, working the bottom by drawing in step (10), working the edges by drawing in steps (11) and (12), bending the walls of the U-shaped groove in step (13) and further bending the walls by drawing in step (14). By repeating the drawing operations of a relatively thick plate in this manner, the press-fitting portion is formed to have a cross-section whose inner periphery forms a U-shaped or V-shaped groove and outer periphery has two arc portions and a straight portions therebetween.

The inner periphery has an inscribing circle whose center is in eccentric relation to the center of the two arc portions of the outer periphery. The thickness of the two arc portions in cross-section progressively decreases on proceeding toward the ends of walls of the U-shaped groove so that the circumferential lengths of the two arc portions contacting the through-hole become longer as much as possible.

Figure 6:
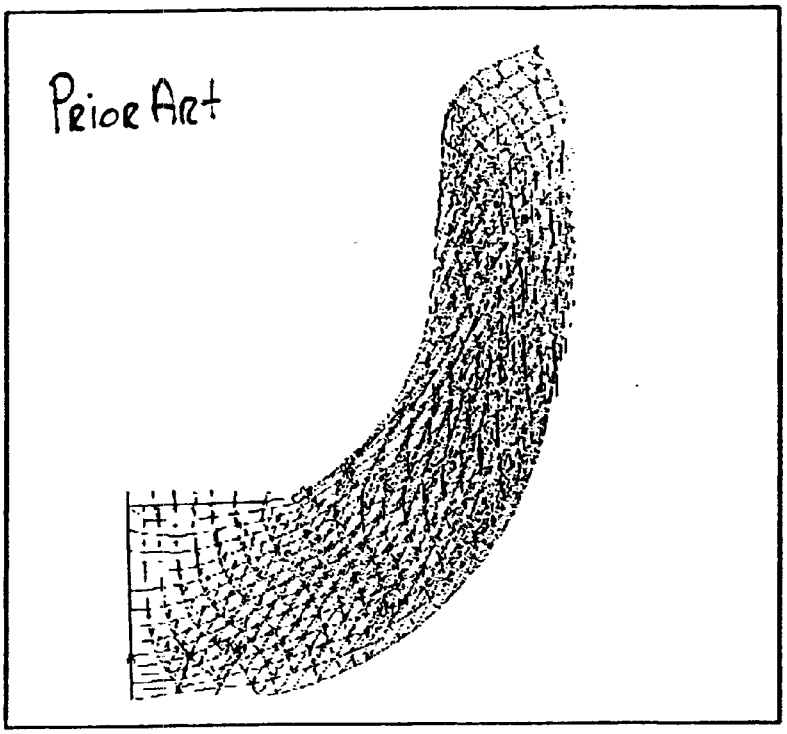
FIG. 6 illustrates a distribution of residual strains in the press-fitting portion of a press-in contact formed by the prior art method.
Figure 7:
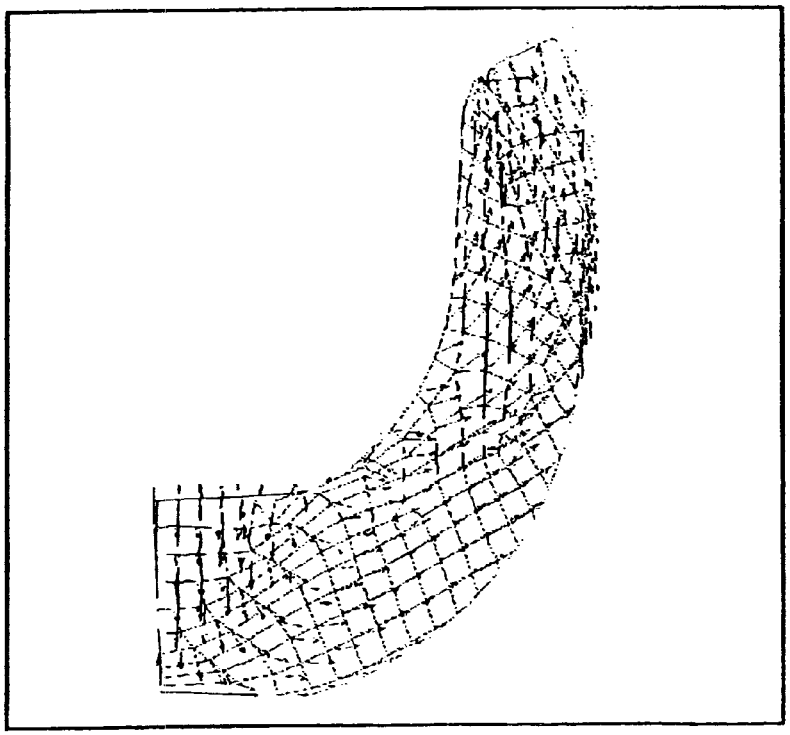
FIG. 7 illustrates a distribution of residual strains in the press-fitting portion of a press-in contact formed according to the invention.

FIG. 6 illustrates the distribution of residual strains in the press-fitting portion of a press-in contact produced by the prior art method using the repeated drawing operations. For the purpose of comparing with it, FIG. 7 illustrates the distribution of residual strains in the press-fitting portion of a press-in contact produced by the method according to the invention. In comparison with FIGS. 6 and 7, it is evident that the residual strains in the press-fitting portion of the contact produced by the method according to the invention are much less than those in the press-fitting portion of the contact produced by the method of the prior art.

According to the present invention, particularly, the arc portions of the U-shaped or V-shaped press-fitting portion of the press-in contact are substantially in symmetry with each other without any irregularity in shape and size to prevent the press-in contact from rotating in a through-hole due to the unbalanced shape of the hole when being press-fitted and to prevent plastic deformations of the open ends of the walls forming the U-shaped groove of the press-fitting portion.

According to the invention, moreover, as the press-fitting portion of a press-in contact is formed by forging, punching and press-working, the residual stresses in the portion act to compress to each other in the longitudinal directions to improve the mechanical properties further, with consequent less chance of its deformation and bending. In this manner, residual compressive stresses are given to the weakest portion of a contact to improve its mechanical property and the reliability of the product.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of manufacturing a press-in contact, wherein the press-in contact comprises a press-fitting element, a connection element formed at a first end of the press-fitting element, and a contact element formed at a second end of the press-fitting element, a improvement for forming the press-fitting element by:

providing a block element, wherein said block element has a substantially rectangular-cross section;

forging said block element, wherein the step of forging comprises the steps of:

forming a groove within said block element, wherein said groove has a first side wall and a second side wall; and forming a convex segment within said groove which extends from at least a portion of a bottom of said groove;

after the step of forming the convex segment removing at least a portion of said first side wall and at least a portion of said second side wall using a single punching step; then shaping said first side wall and said second side wall; then bending said first side wall towards said second side wall; then and bending said second side wall towards said first side wall.

2. A method of manufacturing a press-fitting element of a press-in contact comprising the steps of:

providing a block element, wherein said block element has a substantially rectangular-cross section;

forging said block element, wherein the step of forging comprises the steps of:

forming a groove within said block element, wherein said groove has a first side wall and a second side wall; and forming a convex segment within said groove which extends from at least a portion of a bottom of said groove;

after the step of forming the convex segment removing at least a portion of said first side wall and at least a portion of said second side wall using a single punching step; then shaping said first side wall and said second side wall; then bending said first side wall towards said second side wall; then and bending said second side wall towards said first side wall.

* * * * *

UNITED STATES PATENT AND TRADEMARK OFFICE

CERTIFICATE OF CORRECTION

PATENT NO. : 6,513,237 B1
DATED : February 4, 2003
INVENTOR(S) : Ohtsuki, Tomonari It is certified that error appears in the above-identified patent and that said Letters Patent is hereby corrected as shown below:

Title page, Item [54] and Column 1, line 1,
"PRESSIN" should read -- PRESS-IN --

Title page,
Item [57], ABSTRACT,
Line 1, "press in" should read -- press-in --
Line 6, "concaved" should read -- concave --

Column 2,
Line 19, "concaved" should read -- concave --
Line 34, "strains" should read -- strain --
Line 39, "strains" (both occurrences) should read -- strain --

Column 3,
Line 34, "caved" should read -- cave --

Column 4,
Line 52, "a" should read -- an --
Line 55, "rectangular-cross section;" should read -- rectangular cross-section; --
Line 64, "segment removing" should read -- segment, removing --

Column 5,
Line 3, "then and" should read -- and then --
Line 8, "rectangular-cross section;" should read -- rectangular cross-section; --

Column 6,
Line 4, "segment removing" should read -- segment, removing --
Line 10, "then and" should read -- and then --

Signed and Sealed this

Twenty-fourth Day of June, 2003

JAMES E. ROGAN
*Director of the United States Patent and Trademark Office*